US008469593B2

(12) United States Patent
Price et al.

(10) Patent No.: US 8,469,593 B2
(45) Date of Patent: Jun. 25, 2013

(54) RECLOSABLE BAG HAVING A PRESS-TO-VENT ZIPPER

(75) Inventors: William D. Price, Midland, MI (US); Richard R. Dawkins, Saginaw, MI (US)

(73) Assignee: S.C. Johnson & Son, Inc., Racine, WI (US)

( * ) Notice: Subject to any disclaimer, the term of this patent is extended or adjusted under 35 U.S.C. 154(b) by 230 days.

(21) Appl. No.: 13/031,843

(22) Filed: Feb. 22, 2011

(65) Prior Publication Data

US 2012/0213455 A1 Aug. 23, 2012

(51) Int. Cl.

| | |
|---|---|
| ***B65D 33/16*** | (2006.01) |
| ***B65D 33/01*** | (2006.01) |
| ***A44B 1/04*** | (2006.01) |
| ***A44B 19/00*** | (2006.01) |

(52) U.S. Cl.
USPC ..... 383/63; 383/100; 24/399; 24/400; 24/585.12

(58) Field of Classification Search
USPC ..... 383/63, 59, 100; 24/399, 400, 585.12
See application file for complete search history.

(56) References Cited

U.S. PATENT DOCUMENTS

| | | | |
|---|---|---|---|
| 2,035,674 | A | 3/1936 | Sipe |
| 2,822,012 | A | 2/1958 | Gold |
| 3,338,284 | A | 8/1967 | Ausnit |
| 3,381,592 | A | 5/1968 | Ravel |
| 3,416,585 | A | 12/1968 | Staller |
| 3,565,147 | A | 2/1971 | Ausnit |
| RE27,174 | E | 9/1971 | Ausnit |
| 3,937,395 | A | 2/1976 | Lawes |
| RE28,969 | E | 9/1976 | Naito |
| 4,186,786 | A | 2/1980 | Kirkpatrick |
| 4,191,076 | A | 3/1980 | Bollmer et al. |
| 4,285,105 | A | 8/1981 | Kirkpatrick |
| 4,285,376 | A | 8/1981 | Ausnit |
| 4,363,345 | A | 12/1982 | Scheibner |
| 4,372,014 | A | 2/1983 | Simpson |
| 4,419,159 | A | 12/1983 | Herrington |

(Continued)

FOREIGN PATENT DOCUMENTS

| | | | |
|---|---|---|---|
| DE | 1226817 | B | 10/1966 |
| DE | 2504863 | A1 | 8/1976 |
| WO | 8600867 | A1 | 2/1986 |

OTHER PUBLICATIONS

Printout of website page "http://www.perdue.com/products/subcategory-features.html?category_id=29" on Dec. 1, 2010.

(Continued)

*Primary Examiner* — Jes F Pascua

(57) ABSTRACT

A recloseable pouch defining an interior including a first wall, a second wall opposing and partially sealed to the first wall to form an opening, and a closure mechanism for selectively sealing the opening. The closure mechanism includes a female closure element having first and second spaced legs extending from the first wall that are substantially symmetric about a longitudinal centerline and defining female sealing surfaces. The closure mechanism also includes a male closure element including a proximal base portion extending from the second wall, a neck portion forming male sealing surfaces to engage the female sealing surfaces, and a distal head portion. The male closure element has a plurality of intermittent deformed portions so that upon inserting the proximal base portion into the female closure element, the female closure element deflects and, in turn, fluid is allowed to flow past the closure mechanism via the adjacent intermittent portions.

21 Claims, 10 Drawing Sheets

U.S. PATENT DOCUMENTS

| | | | |
|---|---|---|---|
| 4,428,788 | A | 1/1984 | Kamp |
| 4,479,244 | A | 10/1984 | Ausnit |
| 4,484,352 | A | 11/1984 | Katzin |
| 4,515,647 | A | 5/1985 | Behr |
| 4,522,678 | A | 6/1985 | Zieke |
| 4,532,652 | A | 7/1985 | Herrington |
| 4,555,282 | A | 11/1985 | Yano |
| 4,561,108 | A | 12/1985 | Kamp |
| 4,561,109 | A | 12/1985 | Herrington |
| 4,562,027 | A | 12/1985 | Behr et al. |
| 4,578,813 | A | 3/1986 | Ausnit |
| 4,586,319 | A | 5/1986 | Ausnit |
| 4,615,045 | A | 9/1986 | Siegel |
| 4,618,383 | A | 10/1986 | Herrington |
| 4,655,862 | A | 4/1987 | Christoff et al. |
| 4,672,723 | A | 6/1987 | Hugues et al. |
| 4,673,383 | A | 6/1987 | Bentsen |
| 4,676,851 | A | 6/1987 | Scheibner et al. |
| 4,683,015 | A | 7/1987 | Wagers |
| 4,698,118 | A | 10/1987 | Takahashi |
| 4,701,358 | A | 10/1987 | Behr et al. |
| 4,709,399 | A | 11/1987 | Sanders |
| 4,709,400 | A | 11/1987 | Bruno |
| 4,710,968 | A | 12/1987 | Borchardt et al. |
| 4,736,451 | A | 4/1988 | Ausnit |
| 4,736,496 | A | 4/1988 | Fisher et al. |
| 4,741,789 | A | 5/1988 | Zieke et al. |
| 4,755,248 | A | 7/1988 | Geiger et al. |
| 4,764,977 | A | 8/1988 | Wagers |
| 4,787,880 | A | 11/1988 | Ausnit |
| 4,788,282 | A | 11/1988 | Deziel |
| 4,791,710 | A | 12/1988 | Nocek et al. |
| 4,792,240 | A | 12/1988 | Ausnit |
| 4,796,300 | A | 1/1989 | Branson |
| 4,812,056 | A | 3/1989 | Zieke |
| 4,812,192 | A | 3/1989 | Woods et al. |
| 4,822,539 | A | 4/1989 | Tilman et al. |
| 4,829,641 | A | 5/1989 | Williams |
| 4,832,768 | A | 5/1989 | Takahashi |
| 4,834,554 | A | 5/1989 | Stetler, Jr. et al. |
| 4,846,586 | A | 7/1989 | Bruno |
| 4,859,259 | A | 8/1989 | Scheibner |
| 4,869,725 | A | 9/1989 | Schneider et al. |
| 4,898,492 | A | 2/1990 | Janowski |
| 4,906,310 | A | 3/1990 | Broderick et al. |
| 4,907,321 | A | 3/1990 | Williams |
| 4,923,701 | A | 5/1990 | VanErden |
| 4,941,238 | A | 7/1990 | Clark |
| 4,964,739 | A | 10/1990 | Branson et al. |
| 5,009,828 | A | 4/1991 | McCree |
| 5,012,561 | A | 5/1991 | Porchia et al. |
| 5,017,021 | A | 5/1991 | Simonsen et al. |
| 5,022,530 | A | 6/1991 | Zieke |
| 5,023,122 | A | 6/1991 | Boeckmann et al. |
| RE33,674 | E | 8/1991 | Uramoto |
| 5,049,223 | A | 9/1991 | Dais et al. |
| 5,053,091 | A | 10/1991 | Giljam et al. |
| 5,056,933 | A | 10/1991 | Kamp |
| 5,067,822 | A | 11/1991 | Wirth et al. |
| 5,070,584 | A | 12/1991 | Dais et al. |
| 5,092,684 | A | 3/1992 | Weeks |
| 5,138,750 | A | 8/1992 | Gundlach et al. |
| 5,140,727 | A | 8/1992 | Dais et al. |
| 5,141,577 | A | 8/1992 | Porchia et al. |
| 5,154,086 | A | 10/1992 | Porchia et al. |
| 5,167,454 | A | 12/1992 | Woods et al. |
| 5,184,896 | A | 2/1993 | Hammond et al. |
| 5,186,543 | A | 2/1993 | Cochran |
| 5,192,135 | A | 3/1993 | Woods et al. |
| 5,198,055 | A | 3/1993 | Wirth et al. |
| 5,209,574 | A | 5/1993 | Tilman |
| 5,211,481 | A | 5/1993 | Tilman |
| 5,235,731 | A | 8/1993 | Anzai et al. |
| 5,238,306 | A | 8/1993 | Heintz et al. |
| 5,248,201 | A | 9/1993 | Kettner et al. |
| 5,252,281 | A | 10/1993 | Kettner et al. |
| 5,259,904 | A | 11/1993 | Ausnit |
| 5,273,511 | A | 12/1993 | Boeckman |
| 5,307,552 | A | 5/1994 | Dais et al. |
| 5,326,176 | A | 7/1994 | Domke |
| 5,345,659 | A | 9/1994 | Allan |
| 5,356,222 | A | 10/1994 | Kettner et al. |
| 5,358,334 | A | 10/1994 | Simonsen |
| 5,366,294 | A | 11/1994 | Wirth et al. |
| 5,368,394 | A | 11/1994 | Scott et al. |
| 5,369,847 | A | 12/1994 | Naya et al. |
| 5,382,094 | A | 1/1995 | Ausnit |
| 5,384,942 | A | 1/1995 | Siegel |
| 5,388,910 | A | 2/1995 | Koyanagi |
| 5,397,182 | A | 3/1995 | Gaible et al. |
| 5,403,094 | A | 4/1995 | Tomic |
| 5,405,561 | A | 4/1995 | Dais et al. |
| 5,415,904 | A | 5/1995 | Takubo et al. |
| 5,462,360 | A | 10/1995 | Tilman et al. |
| 5,474,382 | A | 12/1995 | May |
| 5,478,228 | A | 12/1995 | Dais et al. |
| 5,492,705 | A | 2/1996 | Porchia et al. |
| 5,509,734 | A | 4/1996 | Ausnit |
| 5,511,884 | A | 4/1996 | Bruno et al. |
| 5,525,363 | A | 6/1996 | Herber et al. |
| 5,527,112 | A | 6/1996 | Dais et al. |
| 5,540,500 | A | 7/1996 | Tanaka |
| 5,558,493 | A | 9/1996 | Hayashi et al. |
| 5,564,834 | A | 10/1996 | Porchia et al. |
| 5,575,747 | A | 11/1996 | Dais et al. |
| 5,577,305 | A | 11/1996 | Johnson |
| 5,588,187 | A | 12/1996 | Swain |
| 5,611,627 | A | 3/1997 | Belias et al. |
| 5,618,111 | A | 4/1997 | Porchia et al. |
| 5,647,100 | A | 7/1997 | Porchia et al. |
| 5,655,273 | A | 8/1997 | Tomic et al. |
| 5,660,479 | A | 8/1997 | May et al. |
| 5,664,299 | A | 9/1997 | Porchia et al. |
| 5,669,715 | A | 9/1997 | Dobreski et al. |
| 5,672,009 | A | 9/1997 | Malin |
| 5,686,126 | A | 11/1997 | Noel et al. |
| 5,689,866 | A | 11/1997 | Kasai et al. |
| 5,704,670 | A | 1/1998 | Surplus |
| 5,711,609 | A | 1/1998 | Simonsen |
| 5,713,669 | A | 2/1998 | Thomas et al. |
| 5,718,024 | A | 2/1998 | Robbins |
| 5,720,557 | A | 2/1998 | Simonsen |
| 5,722,128 | A | 3/1998 | Toney et al. |
| 5,729,876 | A | 3/1998 | Johnson |
| 5,747,126 | A | 5/1998 | Van Erden et al. |
| 5,749,658 | A | 5/1998 | Kettner |
| 5,769,772 | A | 6/1998 | Wiley |
| 5,774,955 | A | 7/1998 | Borchardt et al. |
| 5,775,812 | A | 7/1998 | St. Phillips et al. |
| 5,783,012 | A | 7/1998 | Porchia et al. |
| 5,791,783 | A | 8/1998 | Porchia et al. |
| 5,794,315 | A | 8/1998 | Crabtree et al. |
| 5,804,265 | A | 9/1998 | Saad et al. |
| 5,809,621 | A | 9/1998 | McCree et al. |
| 5,817,380 | A | 10/1998 | Tanaka |
| 5,827,163 | A | 10/1998 | Kettner |
| 5,832,145 | A | 11/1998 | Dais et al. |
| 5,832,570 | A | 11/1998 | Thorpe et al. |
| 5,836,056 | A | 11/1998 | Porchia et al. |
| 5,839,831 | A | 11/1998 | Mazzocchi |
| D406,685 | S | 3/1999 | McGinnis |
| 5,878,468 | A | 3/1999 | Tomic et al. |
| 5,902,046 | A | 5/1999 | Shibata |
| 5,911,508 | A | 6/1999 | Dobreski et al. |
| 5,927,855 | A | 7/1999 | Tomic et al. |
| 5,930,877 | A | 8/1999 | Thorpe et al. |
| 5,933,927 | A | 8/1999 | Miller et al. |
| 5,934,806 | A | 8/1999 | Tomic et al. |
| 5,950,285 | A | 9/1999 | Porchia et al. |
| 5,953,796 | A | 9/1999 | McMahon et al. |
| 5,955,160 | A | 9/1999 | Tanaka et al. |
| 5,964,532 | A | 10/1999 | St. Phillips et al. |
| 5,967,663 | A | 10/1999 | Vaquero et al. |
| 5,988,880 | A | 11/1999 | Tomic |
| 6,009,603 | A | 1/2000 | Gallagher |
| 6,010,244 | A | 1/2000 | Dobreski et al. |
| 6,014,795 | A | 1/2000 | McMahon et al. |

6,030,122 A 2/2000 Ramsey et al.
6,032,437 A 3/2000 Bois
6,050,726 A 4/2000 Hoerl
6,058,998 A 5/2000 Kristen
6,071,011 A 6/2000 Thomas et al.
6,074,096 A 6/2000 Tilman
6,077,208 A 6/2000 Larkin et al.
6,080,252 A 6/2000 Plourde
6,110,586 A 8/2000 Johnson
6,112,374 A 9/2000 Van Erden
6,135,636 A 10/2000 Randall
6,138,329 A 10/2000 Johnson
6,139,186 A 10/2000 Fraser
6,148,588 A 11/2000 Thomas et al.
6,149,302 A 11/2000 Taheri
6,152,600 A 11/2000 Tomic
6,156,363 A 12/2000 Chen et al.
6,164,825 A 12/2000 Larkin et al.
6,167,597 B1 1/2001 Malin
6,170,696 B1 1/2001 Tucker et al.
6,170,985 B1 1/2001 Shabram, Jr. et al.
6,187,396 B1 2/2001 Moller
6,210,038 B1 4/2001 Tomic
6,217,215 B1 4/2001 Tomic
6,217,216 B1 4/2001 Taheri
6,220,754 B1 4/2001 Stiglic et al.
6,221,484 B1 4/2001 Leiter
6,228,484 B1 5/2001 Willert-Porada et al.
6,228,485 B1 5/2001 Leiter
6,231,236 B1 5/2001 Tilman
6,257,763 B1 7/2001 Stolmeier et al.
6,279,298 B1 8/2001 Thomas et al.
6,286,681 B1 9/2001 Wilfong, Jr. et al.
6,286,999 B1 9/2001 Cappel et al.
6,293,701 B1 9/2001 Tomic
6,299,353 B1 10/2001 Piechocki et al.
6,318,894 B1 11/2001 Derenthal
6,321,423 B1 11/2001 Johnson
6,360,513 B1 3/2002 Strand et al.
6,371,643 B2 4/2002 Saad et al.
6,386,762 B1 5/2002 Randall et al.
6,394,652 B2 5/2002 Meyer et al.
6,398,411 B2 6/2002 Metzger
6,443,617 B2 9/2002 Tetenborg
6,461,042 B1 10/2002 Tomic et al.
6,461,043 B1 10/2002 Healy et al.
6,481,890 B1 11/2002 VandenHeuvel
6,487,758 B2 12/2002 Shaffer et al.
6,491,433 B2 12/2002 Shabram, Jr. et al.
6,539,594 B1 4/2003 Kasai et al.
6,550,965 B2 4/2003 Shaffer et al.
6,550,966 B1 4/2003 Saad et al.
6,553,740 B2 4/2003 Delisle
6,571,430 B1 6/2003 Savicki et al.
6,574,939 B1 6/2003 Heijnen et al.
6,581,249 B1 6/2003 Savicki et al.
6,582,122 B2 6/2003 Shimizu
6,592,260 B1 7/2003 Randall et al.
6,594,872 B2 7/2003 Cisek
6,637,937 B2 10/2003 Bois
6,637,939 B2 10/2003 Huffer
6,686,005 B2 2/2004 White et al.
6,691,383 B2 2/2004 Linton
6,692,147 B2 2/2004 Nelson
6,703,046 B2 3/2004 Fitzhugh et al.
6,712,509 B2 3/2004 Cappel
6,786,712 B2 9/2004 Cisek
6,789,946 B2 9/2004 Plourde et al.
6,854,886 B2 2/2005 Piechocki et al.
6,874,938 B2 4/2005 Price et al.
6,877,898 B2 4/2005 Berich et al.
6,953,542 B2 10/2005 Cisek
6,954,969 B1 10/2005 Sprehe
6,955,465 B2 10/2005 Machacek et al.
6,962,439 B2 11/2005 Taheri
6,994,535 B2 2/2006 Pawloski
7,004,632 B2 2/2006 Hamilton et al.
7,017,240 B2 3/2006 Savicki
7,036,988 B2 5/2006 Olechowski
7,087,130 B2 8/2006 Wu et al.
7,137,736 B2 11/2006 Pawloski et al.
7,163,706 B2 1/2007 Shepard et al.
RE39,505 E 3/2007 Thomas et al.
7,234,865 B2 6/2007 Piechocki
7,241,046 B2 7/2007 Piechocki et al.
7,260,871 B2 * 8/2007 Borchardt et al. ..... 24/399
7,270,479 B2 9/2007 Nelson
7,305,742 B2 12/2007 Anderson
7,322,747 B2 1/2008 Borchardt
7,334,682 B2 2/2008 Goepfert
7,347,624 B2 3/2008 Savicki, Sr. et al.
RE40,284 E 5/2008 Thomas et al.
7,410,298 B2 8/2008 Pawloski
7,437,805 B2 10/2008 Berich
7,517,484 B2 4/2009 Wu
7,534,039 B2 5/2009 Wu
7,543,361 B2 6/2009 Borchardt et al.
7,553,082 B2 6/2009 Yoder
7,585,111 B2 9/2009 Turvey et al.
7,651,271 B2 1/2010 Withers
7,674,039 B2 3/2010 McMahon et al.
7,674,040 B2 3/2010 Dowd et al.
7,736,058 B2 6/2010 Tanaka et al.
7,967,509 B2 * 6/2011 Turvey et al. ..... 383/63
8,272,107 B2 * 9/2012 Turvey et al. ..... 24/30.5 R
2002/0064582 A1 5/2002 Carabetta et al.
2002/0090151 A1 7/2002 Skeens et al.
2002/0153273 A1 10/2002 Mallik et al.
2002/0173414 A1 11/2002 Leighton
2003/0169948 A1 9/2003 Fenzl et al.
2003/0177619 A1 9/2003 Cisek
2003/0210836 A1 11/2003 Strand
2003/0223654 A1 12/2003 Gerrits
2003/0223657 A1 12/2003 Belias et al.
2003/0232112 A1 12/2003 Whitmore et al.
2004/0001651 A1 1/2004 Pawloski
2004/0078939 A1 4/2004 Pawloski
2004/0078940 A1 4/2004 Ishizaki
2004/0131283 A1 7/2004 Sprague et al.
2004/0234171 A1 11/2004 Dais et al.
2004/0234173 A1 11/2004 Saad et al.
2004/0256761 A1 12/2004 Pawloski
2005/0034427 A1 2/2005 Higer et al.
2005/0063616 A1 3/2005 Chang
2005/0141786 A1 6/2005 Piechocki et al.
2005/0207679 A1 9/2005 Armstrong
2005/0271308 A1 12/2005 Pawloski
2005/0276524 A1 12/2005 Taheri
2005/0281921 A1 12/2005 Langston et al.
2005/0286810 A1 12/2005 Sprague et al.
2005/0286811 A1 12/2005 Sprague et al.
2005/0286812 A1 12/2005 Sprague et al.
2006/0008185 A1 * 1/2006 Borchardt ..... 383/63
2006/0008187 A1 1/2006 Armstrong
2006/0078232 A1 4/2006 Trinko
2006/0165316 A1 7/2006 Cheung
2006/0257533 A1 11/2006 Plourde et al.
2007/0155607 A1 7/2007 Bassett et al.
2007/0183692 A1 8/2007 Pawloski
2007/0206888 A1 9/2007 Chang
2008/0137995 A1 6/2008 Fraser et al.
2008/0159662 A1 7/2008 Dowd et al.
2008/0226202 A1 9/2008 Dais et al.
2008/0226203 A1 9/2008 Dais et al.
2008/0232722 A1 9/2008 Pawloski et al.
2008/0285897 A1 11/2008 Taheri
2008/0292222 A1 11/2008 Snoreck
2009/0034885 A1 2/2009 McGruder
2009/0052809 A1 2/2009 Sampson
2009/0097781 A1 4/2009 Tang
2009/0190860 A1 7/2009 Kettner et al.
2009/0214141 A1 8/2009 Borchardt et al.
2009/0232421 A1 9/2009 Turvey
2009/0257685 A1 10/2009 Matias
2009/0304311 A1 12/2009 Noguchi et al.
2010/0014786 A1 1/2010 Pawloski et al.
2010/0166341 A1 7/2010 McMahon et al.

| | | | | |
|---|---|---|---|---|
| 2012/0106874 | A1* | 5/2012 | Pawloski | 383/63 |
| 2012/0106875 | A1* | 5/2012 | Pawloski | 383/64 |
| 2012/0106876 | A1* | 5/2012 | Pawloski | 383/97 |

OTHER PUBLICATIONS

Printout of website page "http://www.daymarksafety.com/deptitem/I/P342/n/8.5_x_8.5%22_Day_of_the_Week_Bags/" on Dec. 1, 2010.

Printout of website page "http://www.daymarksafety.com/deptitem/I/P243/n/Acrylic_Portion_Bag_Dispenser/" on Dec. 1, 2010.

Printout of webstie page "http://www.glad.com.au/glad-products/food-management/glad-go-between/" on Dec. 14, 2010.

* cited by examiner

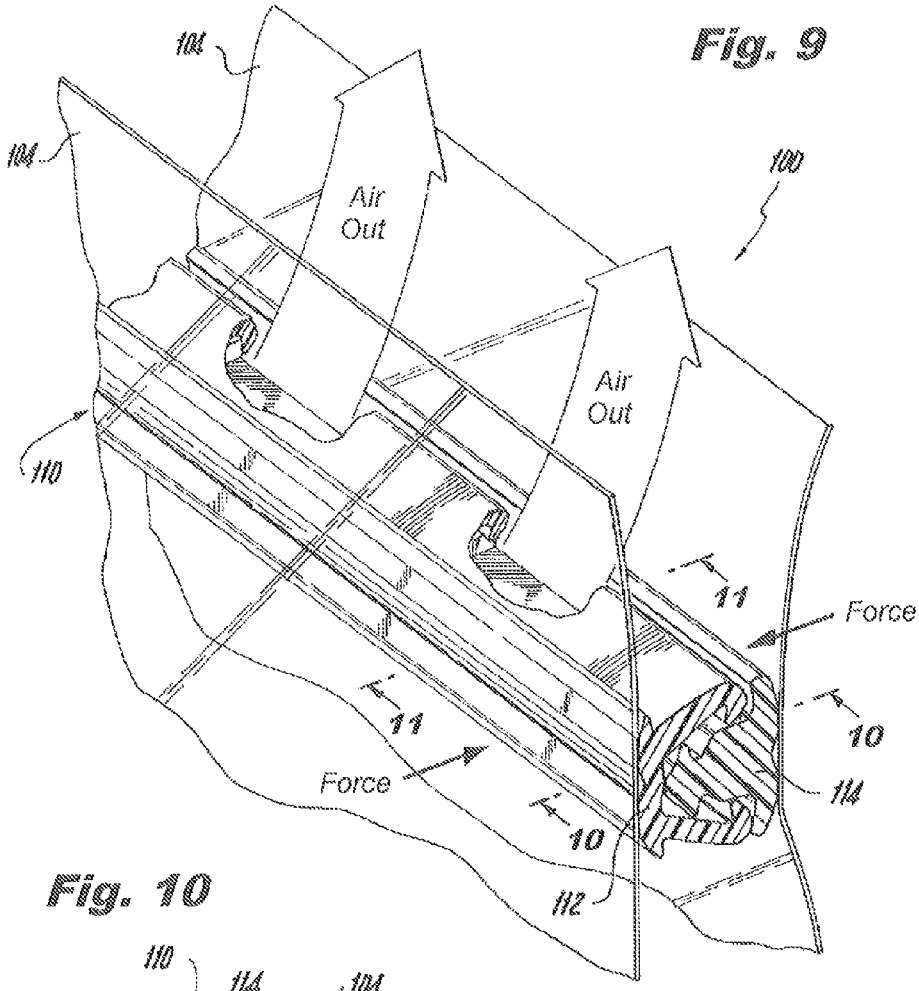
Fig. 9
Fig. 10
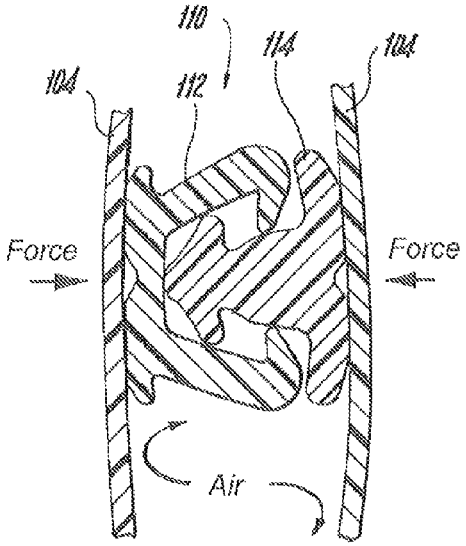
Fig. 11
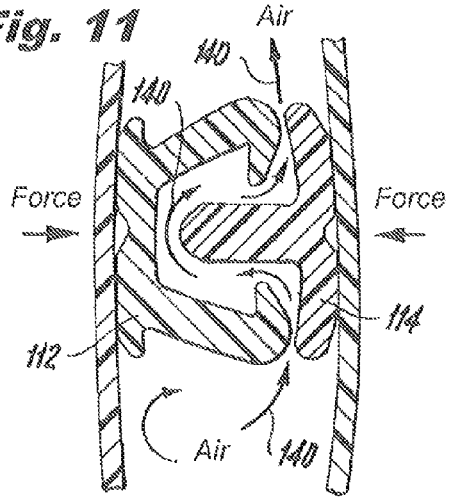

RECLOSABLE BAG HAVING A PRESS-TO-VENT ZIPPER

BACKGROUND OF THE DISCLOSURE

1. Field of the Disclosure

The present disclosure relates to closure mechanisms for resilient pouches, and more particularly, to such closure mechanisms that easily allow for removal of interior air by applying pressure to the closure mechanism.

2. Background of the Related Art

Resilient thermoplastic bags have become ubiquitous to store various items. Commonly, plastic bags are used to store food items as varied as sandwiches, snacks, roasts, and all manner of leftovers. Often, storage of food items in thermoplastic bags can be for a considerable time with or without refrigeration. In such circumstances, not only is it desirable for the bags to seal effectively and easily, but many consumers prefer being able to reduce or minimize the amount of air trapped inside the bag. Consumers believe that a reduction in trapped air preserves freshness better. Further, bags which contain minimal air require less storage space and, thus, are more portable and easily stored.

Use of closure mechanisms for bags has been widely used and well understood in the art. Indeed, the very high skill level of those innovating in the art of closure mechanisms for plastic bags has resulted in a very advanced state of art for closure mechanisms. Despite these advancements, it is still common practice for consumers to partially closely a plastic bag zipper, flatten the bag to remove excess air, and deftly complete closure of the zipper with introducing unwanted air. With various food items, completing this maneuver is difficult and usually somewhat ineffective.

In view of these challenges, many closure mechanism have been developed for plastic bags to allow sealing and removal of air from the bag. Some examples are illustrated in the following: U.S. Pat. No. 7,004,632 issued on Feb. 28, 2006 to Hamilton et al. discloses an adhesive seal to close venting perforations in a bag; U.S. Pat. No. 7,437,805 issued on Oct. 21, 2008 to Berich discloses a pressure sensitive one-way valve in bag; U.S. Pat. No. 6,637,939 issued on Oct. 28, 2003 to Huffer discloses a complex valve for venting a bag; U.S. Pat. No. 7,163,706 issued on Jan. 16, 2007 to Shepard et al. discloses a hook and loop closure venting mechanism; U.S. Pat. No. 7,674,039 issued on Mar. 9, 2010 to McMahon et al. shows a vacuum storage bag; and U.S. Pat. No. 6,692,147 issued on Feb. 17, 2004 to Nelson discloses venting reclosable bags. U.S. Patent Application Pub. No. 2004/0234171 published on Nov. 25, 2004 to Dais et al. also shows a pouch with a venting seal.

U.S. Pat. No. 7,260,871 issued to Borchardt et al. on Aug. 28, 2007 with the title Ventable Interlocking Closure Strip (Borchardt et al.). Borchardt et al. disclose a closure device 52 with opposing hook shaped elements 72, 92 to be interlocked (see FIG. 2 of Borchardt et al.). Hook element 72 has webs 66, 68 supporting dual hooks 72, 74. Similarly, hook element 92 has webs 86, 88 supporting dual hooks 94, 96. In the sealed position of FIG. 7 of Borchardt et al., the opposing hooks 72, 74, 94, 96 are coupled. In a vented position of FIG. 5, the hooks 72, 74, 94, 96 are separated to create a venting flowpath indicated by arrows 145. As can be seen, Borchardt et al. require a delicate touch in that if the closure device 52 is insufficiently pressed, the venting path remains blocked (see FIG. 6 of Borchardt et al.). Additionally, if the closure is pressed too hard, the hooks 72, 74 seal against the base portion 84 to occlude the vent path.

Further, specialized appliances have been developed to seal and/or extract air from bags. Typical appliances create a seal around the mouth of the bag. By using a textured bag, minute flowpaths are created so that when vacuum is applied into the sealed area, air from the interior of the bag is removed. After extracting the interior air, a heating element creates a permanent seal. See for example: U.S. Pat. No. 787,130 issued on Aug. 8, 2006 to Wu et al. that discloses bags for use in such heat sealing appliances; U.S. Pat. No. 6,058,998 issued May 9, 2000 to Kristen that discloses a heat sealing appliance; U.S. Patent Application Pub. No. 2007/0155607 published on Jul. 5, 2007 to Bassett et al. that shows an appliance for evacuation and sealing of resilient bags; and U.S. Patent Application Pub. No. 2005/0034427 published on Feb. 17, 2005 to Higer et al. that shows a vacuum sealing system with a heating element inside the evacuation chamber.

Despite the advances in specialized bags and appliances for removal of interior air and sealing, the prior art mechanisms are not without drawbacks. Once the bags are sealed, one must destroy the bag to access the contents thereof. Further, storage of liquids and/or wet products like fish fillets can be difficult as the presence of the liquid in the sealing area may prevent the heating element completing an effective seal.

SUMMARY OF THE INVENTION

In view of the above, there are problems associated with prior art mechanisms for removing interior air from flexible bags. The prior art systems often require difficult maneuvers to accomplish proper operation. Further, the prior art systems utilize complex and expensive components that are not efficiently manufactured as well as have unreliable performance. Still further, the prior art also provides complex and costly appliances that still may perform poorly. Moreover, it would be a step forward to have an effectively vented and vacuumed bag that could be reused repeatedly. Additionally, it is desired to have a venting closure mechanism that operates effectively in the presence of liquid. In view of the above problems and needs, a lack of widespread consumer acceptance of vacuum storage remains despite a strong consumer demand.

There is a need, therefore, for an improved pouch which permits easy closure and venting of excess interior air. Preferably, the pouch is also suitable to replace prior art systems that require an appliance to assist with heat sealing and creation of a vacuum in the interior. Still further, the closure mechanism of the pouch could work with an appliance that applies an external vacuum source yet still effectively seals in the presence of liquids. The closure mechanism is also able to be opened and resealed repeatedly.

In one embodiment, the present technology is directed to a recloseable pouch defining an interior including a first wall, a second wall opposing and partially sealed to the first wall to form an opening for access to the interior, and a closure mechanism for selectively sealing the opening. The closure mechanism includes a female closure element coupled to the first wall, wherein the female closure element has first and second spaced legs extending from the first wall that are substantially symmetric about a longitudinal centerline and define female sealing surfaces. The closure mechanism also includes a male closure element coupled to the second wall in alignment with the female closure element, wherein the male closure element includes a proximal base portion extending from the second wall, a neck portion forming male sealing surfaces to engage the female sealing surfaces, and a distal head portion. The male closure element has a plurality of intermittent deformed portions so that applying a compressive force upon the closure mechanism causes the female closure element to deform and, in turn, a passageway in the adjacent intermittent deformed portions is formed for fluid to flow past the closure mechanism. In an alternative embodiment, the male closure element has a plurality of intermittent deformed portions so that upon inserting the proximal base portion into the female closure element, the female closure element deflects and, in turn, fluid is allowed to flow past the closure mechanism via the adjacent intermittent portions.

Preferably, the female sealing surfaces are formed on curved distal ends. The distal head portion is a round triangle shape in cross-section and the intermittent portions are notched. The plurality of intermittent notched portions have the distal head substantially squished upward while retaining at least a portion of the male sealing surfaces. The proximal base portion and the distal head portion may be roughened surface portions so that upon inserting the proximal base portion into the female closure element, fluid is allowed to flow past the closure mechanism through the roughened surface portions.

In another embodiment, the subject technology is directed to a recloseable pouch defining an interior including a first wall, a second wall opposing and partially sealed to the first wall to form an opening for access to the interior, and a closure mechanism for selectively sealing the opening. The closure mechanism includes a female closure element coupled to the first wall, wherein the female closure element has first and second spaced legs extending a leg height from the first wall. The closure mechanism also includes a male closure element coupled to the second wall in alignment with the female closure element. Once engaged, the closure mechanism has a springiness or bias such that the normal position is the sealed position. In one embodiment, the female closure element has a base that stores energy for biasing the closure mechanism into the sealed position. The base may contain a notch that allows the base to flex. Preferably, the legs of the female closure element are longer than the male closure element so that the legs are splayed to transmit the energy to the base by virtue of deformation when pressed past the sealed position. In another embodiment, the male closure element has a finger extending a finger height from the second wall. The finger height is longer than the leg height such that upon engagement of the female and male closure elements to form a seal of the opening, the finger is deformable to create a springiness to the seal.

In one embodiment, the finger includes a proximal base portion extending from the second wall, the proximal base portion being oversized with respect to the legs such that, upon engagement, interaction between the proximal base portion and legs creates a force that drives the female and male closure elements into a sealing position. The male closure element may have a plurality of intermittent venting portions so that upon inserting the proximal base portion into the female closure element, the female closure element deforms and, in turn, fluid is allowed to flow past the closure mechanism via the adjacent venting portions. The intermittent venting portions can be notched and/or relatively rougher.

Still another embodiment of the subject technology is directed to a recloseable pouch defining an interior including a first wall, a second wall opposing and partially sealed to the first wall to form an opening for access to the interior, and a closure mechanism for selectively sealing the opening. The closure mechanism includes a female closure element coupled to the first wall, wherein the female closure element defines female sealing surfaces, and a male closure element coupled to the second wall in alignment with the female closure element. The male closure element defines male sealing surfaces to engage the female sealing surfaces with portions of the male closure element having first profile portions and second profile portions, the second profile portions being intermittent and relatively smaller in cross-section than the first profile portions. In a closed position, the female and male sealing surfaces are engaged to seal the opening. In a venting position, the female closure element deforms by insertion of the male closure element therein and, in turn, fluid is allowed to be released from the interior by flowing past the second profile portions.

It should be appreciated that the present technology can be implemented and utilized in numerous ways, including without limitation as a process, an apparatus, a system, a device, a method for applications now known and later developed. These and other unique features of the system disclosed herein will become more readily apparent from the following description and the accompanying drawings.

BRIEF DESCRIPTION OF THE DRAWINGS

So that those having ordinary skill in the art to which the disclosed system appertains will more readily understand how to make and use the same, reference may be made to the following drawings.

FIG. 9 is an enlarged perspective view of a portion of the upper pouch, showing the intermittent venting capability.

FIG. 10 is an enlarged sectional elevation taken at line 10-10 of FIG. 9 showing force being applied to place the normal segment of the closure mechanism in the venting position.

FIG. 11 is an enlarged sectional elevation taken at line 11-11 of FIG. 9 showing force being applied to place the deformed segment of the closure mechanism in the venting position

DETAILED DESCRIPTION OF PREFERRED EMBODIMENTS

Figure 1:
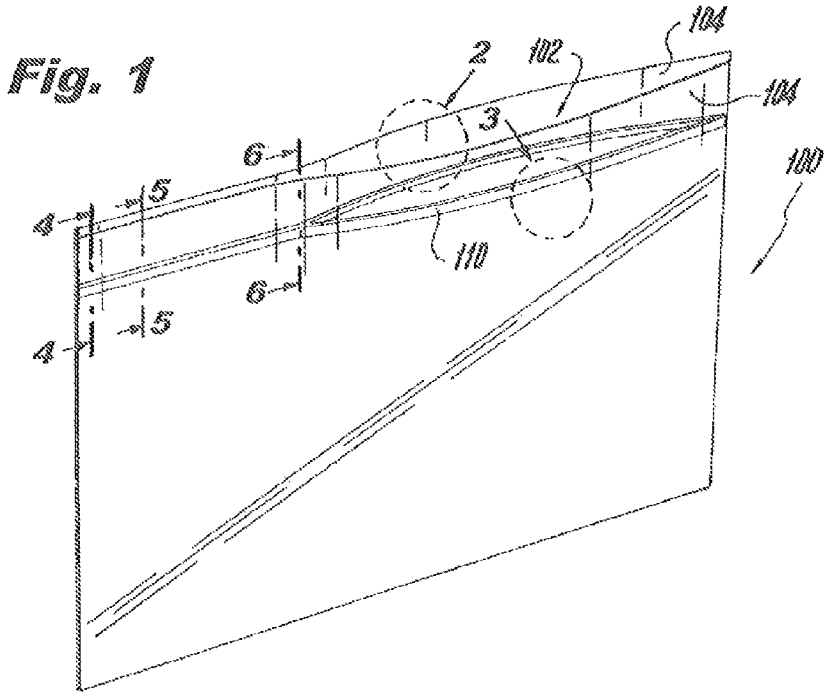
FIG. 1 is a perspective view of a pouch with a closure mechanism partially open in accordance with the subject technology.

The present disclosure overcomes many of the prior art problems associated with vented pouches and bags. The advantages, and other features of the technology disclosed herein, will become more readily apparent to those having ordinary skill in the art from the following detailed description of certain preferred embodiments taken in conjunction with the drawings which set forth representative embodiments of the present invention and wherein like reference numerals identify similar structural elements. All relative descriptions herein such as left, right, up, and down are with reference to the Figures, and not meant in a limiting sense. Unless otherwise specified, the illustrated embodiments can be understood as providing exemplary features of varying detail of certain embodiments, and therefore, unless otherwise specified, features, components, modules, elements, and/or aspects of the illustrations can be otherwise resized, combined, interconnected, sequenced, separated, interchanged, positioned, and/or rearranged without materially departing from the disclosed systems or methods. The shapes and sizes of components are also exemplary and unless otherwise specified, can be altered without materially affecting or limiting the disclosed technology. Additionally, the representations shown herein may be somewhat idealized in that manufacturing processes typically have variation and approximate the features, which can be drawn with clarity beyond that which can be made.

Referring now to FIG. 1, a perspective view of a recloseable pouch 100 with a closure mechanism 110 partially open in accordance with the subject technology is shown. The pouch 100 is preferred by users because the closure mechanism 110 selectively allows for easy venting of interior air after the pouch 100 is completely sealed. The closure mechanism 110 also has a springiness during interlocking that is desirable for both venting and traditional pouches. Additionally, the closure mechanism 110 is well suited for use with an appliance to remove the interior air. Still further, the subject technology will provide an audible and/or tactile cue to proper engagement of the closure mechanism 110, such as shown in U.S. Pat. No. 5,140,727.

The pouch 100 defines an interior for storing any type of item, fluid or solid, that may fit therein. The pouch 100 has opposing walls 104 fabricated from a thermoplastic film. The walls 104 are partially sealed together to form an opening 102 for access to the interior. The opening 102 is selectively sealed and vented by the closure mechanism 110.

Figure 2:
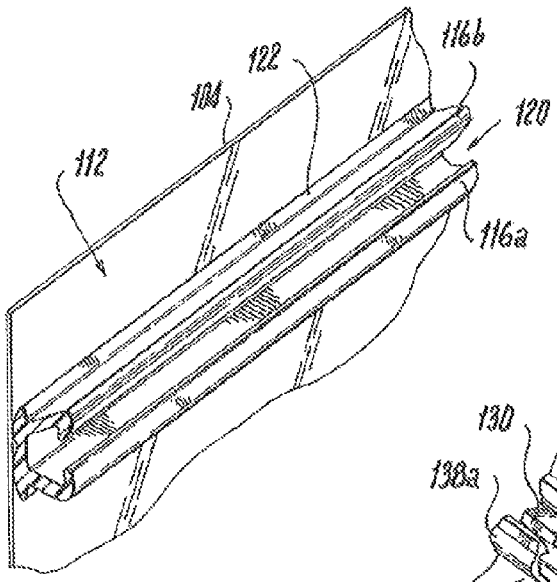
FIG. 2 is an enlarged perspective view of the female closure element of the closure mechanism, taken at circle 2 of FIG. 1.
Figure 3:
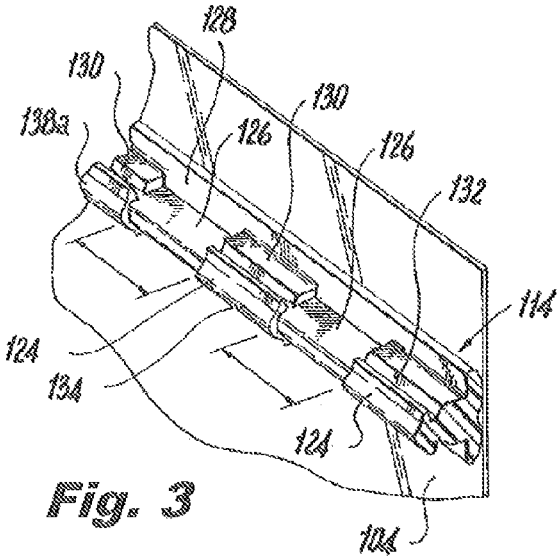
FIG. 3 is an enlarged perspective view of the male element of the closure mechanism, taken at circle 3 of FIG. 1.

Referring now to FIGS. 2 and 3, the closure mechanism 110 includes a female closure element or profile 112, shown in perspective view in FIG. 2, and a male closure element or profile 114, shown in perspective view in FIG. 3. The female and male profiles 112, 114 interlock to form a seal as best seen in cross-section in FIGS. 4 and 5. In one embodiment, the profiles 112, 114 are formed and subsequently welded to the respective wall 104.

Figure 4:
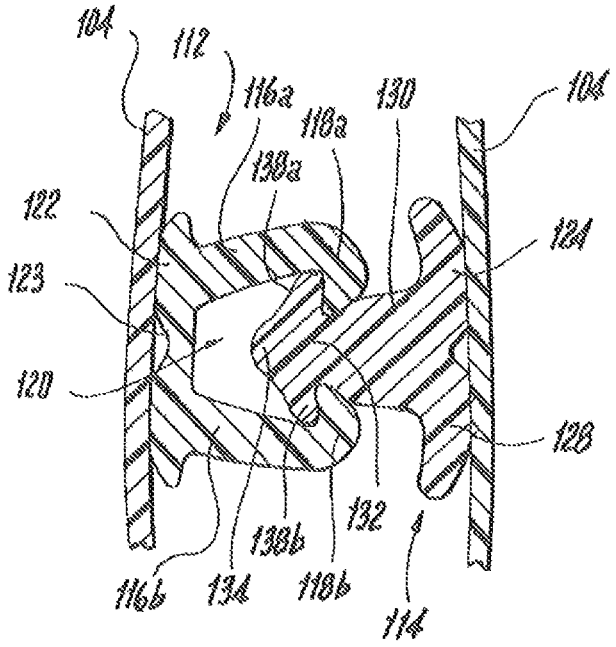
FIG. 4 is a sectional elevation taken at line 4-4 of FIG. 1 showing the normal portion of the male closure element sealingly engaged to the female closure element.

As best seen in FIGS. 2 and 4, the female closure element 112 has opposing spaced apart legs 116*a*, 116*b* that extend from a base 122 attached to the wall 104. The legs 116*a*, 116*b* are substantially symmetric about a transverse longitudinal centerline and terminate in hook portions 118*a*, 118*b* at the distal free end. The base 122 is contoured, which may help guide a user's fingers such as shown in U.S. Pat. No. 7,410,298. The legs 116*a*, 116*b* are resiliently flexible to couple and decouple with the male profile 114. When the legs 116*a*, 116*b* are splayed outward by the male profile 114, the base 122 flexes and stores energy so that the closure mechanism 110 is biased into the sealed position. A notch 123 is formed in the base 122 to increase flexibility of the base 122. The female profile 112 forms a substantially C-shaped channel 120 for receiving the male profile 114. In one embodiment, the channel 120 generally has a diameter of about 0.032 of an inch {0.81280 mm} with an opening between the hook portions 118*a*, 118*b* of about 0.010 of an inch {0.25400 mm}.

Figure 5:
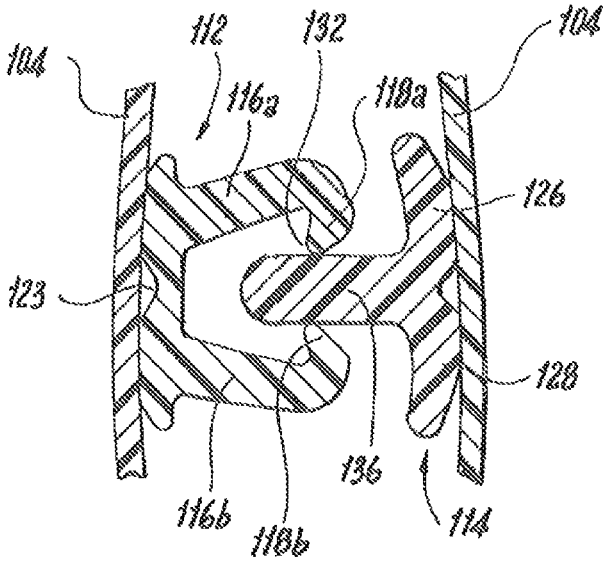
FIG. 5 is a sectional elevation taken at line 5-5 of FIG. 1 showing the deformed portion of the male closure element sealingly engaged to the female closure element.

As best seen in FIGS. 1 and 4, the male closure element 114 extends from the respective wall 104 in alignment with the female closure element 112. The male profile 114 is further characterized by intermittent and preferably alternating first and second segments 124, 126. The first segment 124, illustrated in FIG. 4, is referred to as normal in that the cross-section remains unchanged from the extrusion formation process. However, the second segment 126, illustrated in FIG. 5, is referred to as deformed in the cross-section because the second segment 126 modified after the forming process by deformer wheels or the like as is known to those of ordinary skill in the art and shown in U.S. patent application Ser. No. 12/916,005 filed Oct. 29, 2010.

Preferably, a ratio of the length of the deformed segments 126 to the length of the normal segments 124 is approximately one. Typically, the length of the segments 124, 126 is about 0.15 of an inch {3.81 mm} so that a plurality of deformed segments 126 are depressed by one's fingers during venting as described hereinbelow. In alternative embodiments, the normal segments 124 are significantly longer than the deformed segments 126 or vice versa. In another embodiment, the lengths of the segments 124, 126 vary.

Referring again to FIG. 3, the male closure profile 114 also includes a proximal contoured base 128 that remains substantially unchanged along an entire length of the male closure profile 114. In the normal segment 124 shown in FIG. 4, the male closure profile 114 has a shoulder portion 130 extending from the base 128. The male closure profile 114 terminates with a neck portion 132 and a distal head portion 134. The neck portion 132 and head portion 134 form the sealing surfaces that engage the hook portions 118*a*, 118*b* of the female closure profile 112 to form a seal. As can be seen, the male closure profile 114 in the normal segments 124 is somewhat arrow head shaped in cross-section. The lateral sides 138*a*, 138*b* of the distal head portion 134 also being deflectable and forming sealing surfaces.

In one embodiment, a width of the neck portion 132 is in the range from 0.008 to 0.018 of an inch {0.2032 to 0.4572 mm} at the sealing point. Preferably, the width of the neck portion 132 is approximately 0.013 of an inch {0.3302 mm}. In one embodiment, a width of the base 130 is in the range from 0.015 to 0.028 of an inch {0.381 to 0.7112 mm}. Preferably, the width of the base is approximately 0.023 of an inch {0.5842 mm}. It is envisioned that the base 130 is about 0.010 of an inch {0.25400 mm} wider than the neck portion 132 so that the deformed segments can be notched about 0.005 of an inch {0.127 mm} on each side of the male closure profile 112. In another embodiment, the gap or opening between the hook portions 118*a*, 118*b* of the female closure profile 112 is approximately equal to a width of the neck portion 132 at the sealing point. In still another embodiment, the gap between the hook portions 118*a*, 118*b* of the female closure profile 112 is equal to or less than a width of the neck portion 132 by about 0.002 of an inch {0.0508 mm}. Preferably, the gap between the hook portions 118*a*, 118*b* is approximately 0.001 of an inch {0.0254 mm} less than the width of the neck portion.

Other configurations are possible such as shown in U.S. Pat. No. 5,070,584 issued to Dais et al. on Dec. 10, 1991, U.S. Pat. No. 6,692,147 issued to Nelson on Feb. 17, 2004, U.S. Pat. No. 6,962,439 issued to Taheri on Nov. 8, 2005, U.S. Pat. No. 6,010,244 issued to Dobreski et al. on Jan. 4, 2000, U.S. Pat. No. 7,736,058 issued to Tanaka et al. on Jun. 15, 2010, U.S. Pat. No. 7,322,747 issued to Borchardt on Jan. 29, 2008, and U.S. Pat. No. 7,674,039 issued to McMahon et al. on Mar. 9, 2010 as well as U.S. Patent Application Pub. No. 2004/0234171 to Dais et al. published on Nov. 25, 2004, U.S. Patent Application Pub. No. 2004/0234173 to Saad et al. published on Nov. 25, 2004, U.S. Patent Application Pub. No. 2007/0183692 to Pawloski published on Aug. 9, 2007, and U.S. Patent Application Pub. No. 2006/0008187 to Armstrong published on Jan. 12, 2006.

Referring now to FIG. 5, the deformed segment 126 of the male closure profile 114 also sealingly engages the female closure profile 112. In the deformed segment 126, the shoulder portion 130 and the distal head portion 134 have been effectively reshaped so that although a length is approximately equal, the base shape is a stem 136 approximately as wide as the neck portion 132. Accordingly, the female closure profile 112 seals against the stem 136 of the deformed segment 126 at the remaining neck portion 132, which is relatively unchanged.

Figure 5A:
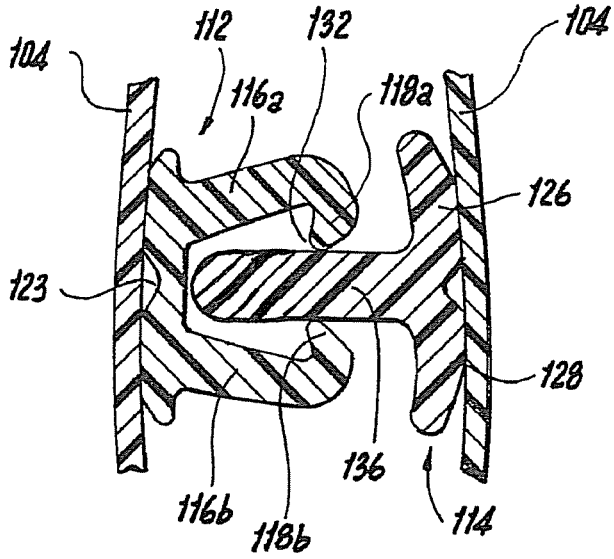
FIG. 5A is a sectional elevation of another embodiment showing the deformed portion of the male closure element sealingly engaged to the female closure element, wherein the deformed portion has had the distal head substantially squished upward while retaining at least a portion of the male sealing surfaces.

Referring now to FIG. 5A, a sectional elevation of another embodiment showing the deformed portion of the male closure element sealingly engaged to the female closure element is shown. Like reference numerals are used to describe similar structures. The deformed portion has had the distal head substantially squished upward while retaining at least a portion of the male sealing surfaces. The deformed segment 126 of the male closure profile 114 also sealingly engages the female closure profile 112. Again, the female closure profile 112 seals against the stem 136 of the deformed segment 126 at the remaining neck portion 132, which is relatively unchanged.

Closing the Pouch

Figure 6:
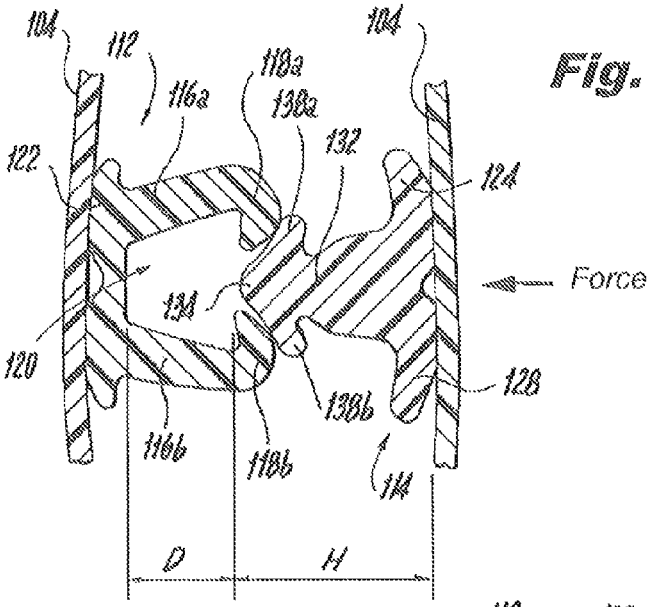
FIG. 6 is an enlarged sectional elevation, taken at line 6-6 of FIG. 1, showing the initial contact between male and female closure elements.
Figure 7:
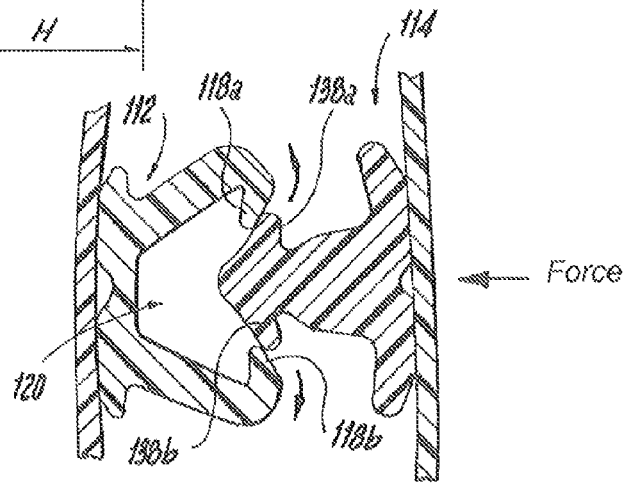
FIG. 7 is an enlarged sectional elevation, taken approximately at line 6-6 of FIG. 1, showing deflection of the female closure element to create engagement between male and female closure elements.
Figure 8:
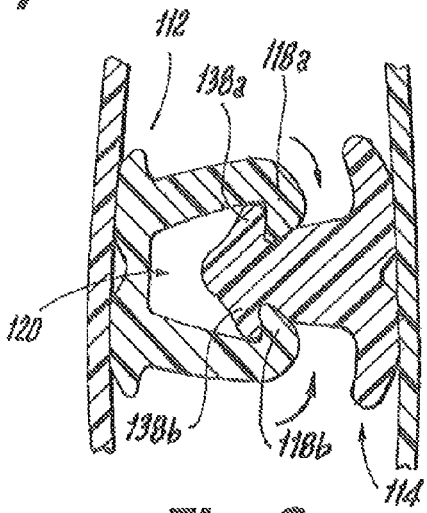
FIG. 8 is an enlarged sectional elevation, taken approximately at line 6-6 of FIG. 1, showing the female closure element returning from the deflection of FIG. 7 to complete engagement between male and female closure elements.

Referring now to FIGS. 6-8, a sequence of the female and male closure profiles 112, 114 being sealingly engaged is shown. As the closure profiles 112, 114 are aligned on the pouch walls 104, when a force F is applied to compress the profiles 112, 114 together, the distal head portion 134 of the male profile 114 aligns with the C-shaped channel 120 as shown in FIG. 6. To help with the alignment, the distal head portion 134 is somewhat pointed. The force F needs to be great enough to deflect the legs 116*a*, 116*b* of the female profile 112 as shown in FIG. 7. As the legs 116*a*, 116*b* deflect, the distal head portion 134 passes into the channel 120. The hook portions 118*a*, 118*b* and lateral members 138*a*, 138*b* of the male closure profile 114 may also deflect.

Referring now particularly to FIG. 8, upon the lateral members 138*a*, 138*b* passing by the hook portions 118*a*, 118*b* so that the distal head portion 134 is within the C-shaped channel 120, the hook portions 118*a*, 118*b* press against the neck portion 132 to form a seal between the female and male closure profiles 112, 114. Hence, the neck portion 132 is sized so that the legs 116*a*, 116*b* are typically still slightly deflected. As shown in FIG. 5, in the deformed section 126, the stem 136 is similarly inserted into the C-shaped channel 120 by the force F. The stem 136 is similarly sized such that the legs 116*a*, 116*b* maintain the hook portions 118*a*, 118*b* against the stem 136 to form an effective seal therebetween.

Still referring to FIGS. 6-8, the closure mechanism 100 has a desirably springiness created by the configuration of the female and male closure elements 112, 114. One of the factors contributing to the springiness is a height H of the male closure element 114 being longer than a depth D of the female closure element 112 such that when the male closure element 114 is forced through the sealing position shown in FIG. 8, into a venting position such as shown in FIG. 10, the distal head portion 134 abuts the contoured base 122 at the bottom of the C-shaped channel 120. In another embodiment, the distal head portion 134 and C-shaped channel 120 are sized and configured so that the lateral portions 138*a*, 138*b* of the distal head portion 134 deflect inward and the legs 116*a*, 116*b* deflect outward to further provide resistance or springiness during insertion.

Under continued force F, the male closure profile 114 deflects to impart a desirable springiness. At the same time, the hook portions 118*a*, 118*b* are also being urged outward by the shoulder portion 130, which is wider than the neck portion 132. Preferably, the shoulder portion 130 tapers from the base 128 to the neck portion 132. Hence, the hook portions 118*a*, 118*b* along with the legs 116*a*, 116*b* are also deflecting further outward as the male closure profile 114 is further inserted to further generate a springiness to the engagement. As a result, the user has an improved confidence that the female and male closure elements 112, 114 are properly interlocked. As the legs 116*a*, 116*b* deflect outward, enerty is stored in the base 122. Upon release of the engagement force F, one or more of the stored engergy in the base 122, the resilient nature of the legs 116*a*, 116*b*, and/or the taper of the shoulder portion 130 bias the hook portions 118*a*, 118*b* to slide down the shoulder portion 130 into the sealed position on the neck portion 126 as shown in FIG. 8 without further action by the user.

Since the stem 136 is generally larger than the separation between the hook portions 118*a*, 118*b* of the female closure profile 112, engagement of the deformed segments 126 still requires force albeit less than for the normal segments 124. Hence, although the female profile 112 deflects less upon insertion of the deformed segments 124, sealing still occurs upon insertion. Also, the stem 136 of the deformed segments 126 is approximately the same height as the normal segments 124 so that upon the stem 136 contacting the base 122, bending of the stem 136 occurs to further enhance the springiness effect. In one embodiment, the stem 136 is relatively longer than the normal segments 124 as the deformed segments 126 are formed by intermittently squishing the normal segments 124 distally such that the shoulder portion 130 and distal head portion 134 are substantially reshaped.

Venting the Closed and Sealed Pouch

Referring now to FIG. 9, an enlarged perspective view of an upper portion of the pouch 100 is shown to illustrate the intermittent venting capability. Excess air can be removed from the pouch 100 without having to undo the closure mechanism 110. Applying compressive force F to the closure mechanism 110 creates a venting passageway. By simultaneously compressing the walls 104 of the pouch 100 at the closure mechanism 110, air can be expelled from the pouch interior via the venting passageway.

Referring now to FIG. 10, an enlarged sectional elevation taken at line 10-10 of FIG. 9 shows force being applied to place the normal segment 124 of the closure mechanism 110 in the venting position. As noted above, by fully inserting the male closure profile 114 into the C-shaped channel 120, the hook portions 118*a*, 118*b* of the female closure profile 112 slide along the taper of the shoulder portion 130 creating a deflection outward. Contact is maintained between the hook portions 118*a*, 118*b* and the shoulder portion 130 so that a sealed engagement is maintained in the normal segments 124.

However, in the deformed segments 126 adjacent and within the compressed portion, a venting passageway 140 is created as shown by the air arrows in FIG. 11. The venting passageway 140 results from the deflection of the female closure profile 112 by the normal segments 124 such that the female closure profile 112 is deflected opposite the adjacent and/or compressed deformed segments 126. Because the stem 136 of the deformed segments 126 has a relatively narrow width near the base 128, the deflection of the legs 116*a*, 116*b* creates the venting passageway 140 between the stem 136 and the hook portions 118*a*, 118*b*. As a result, fluid from the pouch interior is allowed to flow past the closure mechanism 110 via the venting passageways formed in the deformed segments 126. It is envisioned that a user would use one hand to put the closure mechanism 110 in the venting position while simultaneously using the other hand to squeeze the interior air out of the pouch 100.

Figure 12:
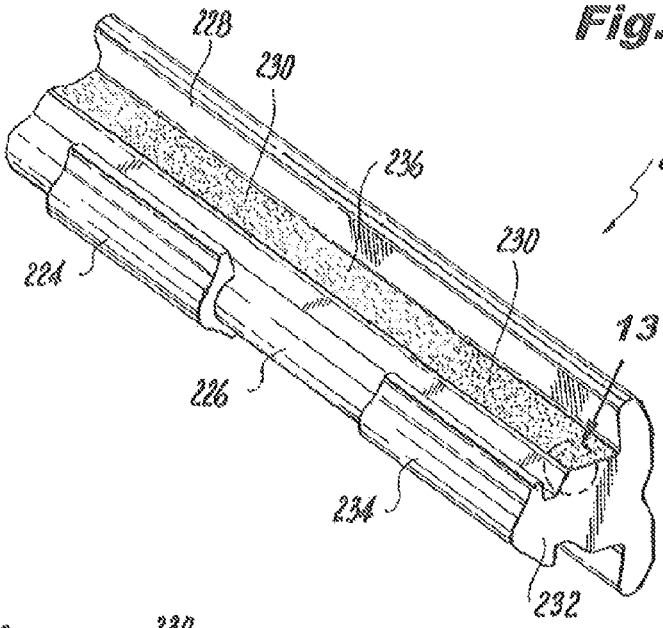
FIG. 12 is an enlarged perspective view of a male closure element of another closure mechanism in accordance with the subject technology.

Referring now to FIG. 12, an enlarged perspective view of an alternative male closure element 214 of another closure mechanism 210 (see FIG. 16) in accordance with the subject technology is shown. As will be appreciated by those of ordinary skill in the pertinent art, the closure mechanism 210 utilizes similar principles to the closure mechanism 110 described above. Accordingly, like reference numerals preceded by the numeral "2" instead of the numeral "1", are used to indicate like elements. Although the male closure element 214 contains normal segments 224 and deformed segments 226, in the deformed segments 226 only the distal head portion 234 has been deformed. Also, the shoulder portion 230 has a roughened surface as opposed to a smooth surface.

Figure 13:
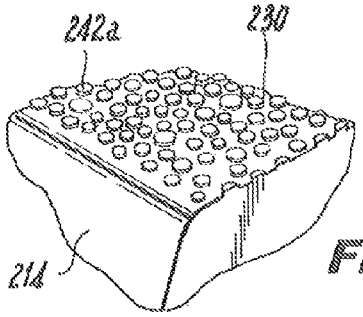
FIG. 13 is an enlarged sectional plan view taken at circle 13 of FIG. 12, showing a portion of the texture of the male closure element.
Figure 16:
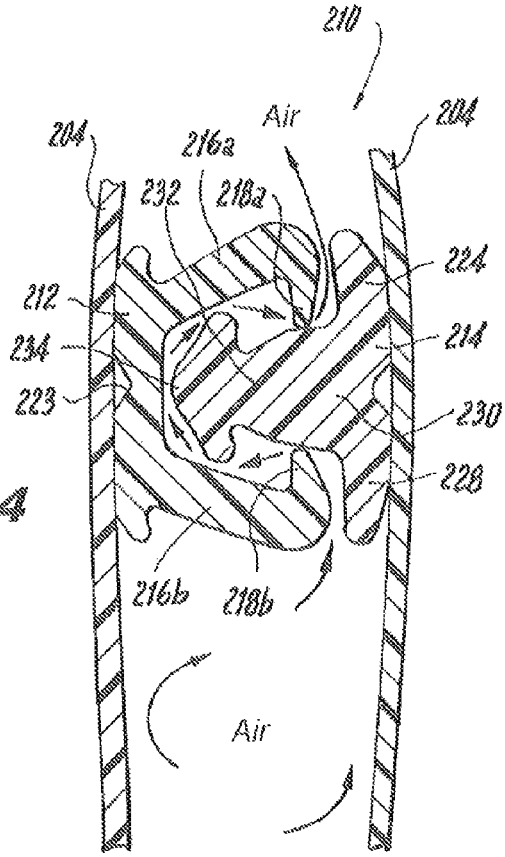
FIG. 16 is a sectional elevation showing a venting passageway for the closure mechanisms of FIGS. 12-15 in accordance with the subject technology.

Referring to FIG. 16, the primary difference of the closure mechanism 210 in comparison to the closure mechanism 110 is the provision of an alternative venting passageway in the normal and deformed segments 224, 226 as shown by the air arrows. The shoulder portion 230 of the male closure profile 224 has a roughened surface 242 as shown in FIG. 13. Thus, as a compressive force is applied to the closure mechanism 210, the hook portions 218*a*, 218*b* not only slide onto the shoulder portion 230 but an effective seal is lost because of the rough surface 242 on the shoulder portion 230. The lack of a seal between the hook portions 218*a*, 218*b* and shoulder portion 230 creates a leak, i.e., a venting passageway 240 in the normal and deformed segments 224, 226. In one embodiment, the venting passageway 240 formed by the rough surface 242 is sufficient to evacuate the interior air. Hence, the male closure profile 224 may be without intermittent deformed portions. In another embodiment, the shoulder portion is roughened to create venting in addition to deformed portions similar to that as described above with respect to FIG. 3.

Figure 14:
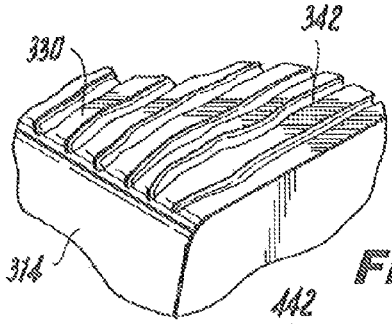
FIG. 14 is an alternative version of texturing of the male closure element of FIG. 12 to permit venting.
Figure 15:
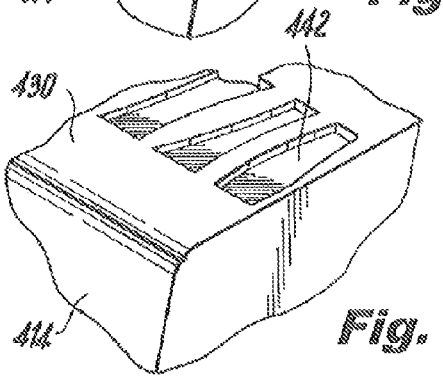
FIG. 15 is still another alternative version of texturing of the male closure element of FIG. 12 to permit venting.

Referring now to FIG. 14, another alternative version of texturing of the shoulder portion 330 of the male closure element 314 is shown. In this embodiment, the shoulder portion 330 forms grooves to create the venting passageway. In FIG. 15, still another alternative version of texturing of the shoulder portion 430 of the male closure element 414 is shown. The shoulder portion 430 forms indentations to create the venting passageway. It is envisioned that any of a plurality of texturing methods and resulting structures may accomplish creating a suitable venting passageway.

A Process and Apparatus for Making the Zipper

The male closure element of the subject technology may be extruded and post-applied or extruded with the pouch as is known in the art. After formation, the male closure element is processed through a deforming apparatus to create the deformed segments. Such deforming apparatus are well known as well. For example, see U.S. Pat. No. 5,140,727, issued to Dais et al. on Aug. 25, 1992 and U.S. Pat. No. 5,647,100, issued to Porchia et al. on Jul. 15, 1997.

Figure 17:
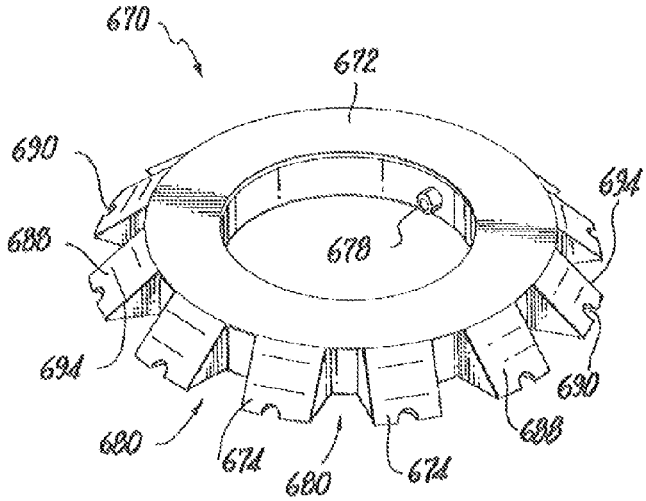
FIG. 17 is perspective view of a deformer ring for use in a deforming apparatus to manufacture a closure mechanism in accordance with the subject technology.
Figure 18:
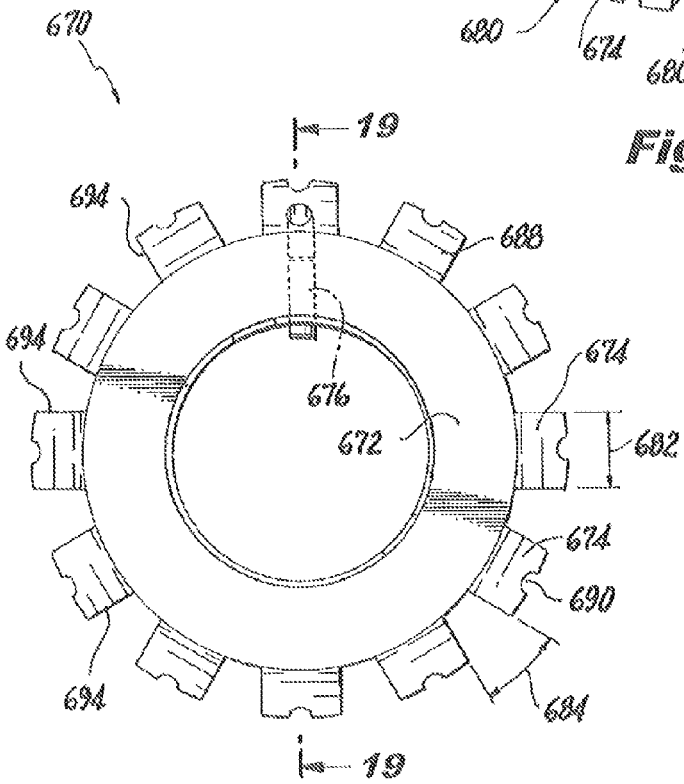
FIG. 18 is top view of the deformer ring of FIG. 17.
Figure 19:
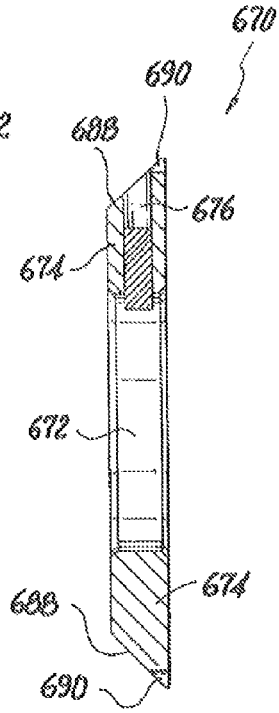
FIG. 19 is cross-sectional view of the deformer ring of FIG. 17 taken along line 19-19.

Now referring to FIGS. 17-19, perspective, top, and cross-sectional views of a novel and improved deformer ring 670 for use in a deforming apparatus (not shown) in accordance with the subject technology are shown. The deformer ring 670 has an annular body 672 with a plurality of teeth 674 formed on an outer circumference thereof. The teeth 674 have an angled surface 688 that applies pressure to deform the male closure element. The angled surfaces 688 also form cutting edges 694 that notch the male closure element. Each angled surface 688 forms a relief notch 690. In one embodiment, the relief notch 690 is about 0.001 to 0.002 of an inch {0.0254 to 0.0508 mm} in arc length and depth.

A throughbore 676 is formed in the annular body 672 to receive a dowel 678, which facilitates mounting the deformer ring 670 to the deforming apparatus. The teeth 674 are separated by gaps 680, which create a tooth arc length 682 and gap arc length 684 on the outermost portion of the deformer ring 670. In use, the size of the tooth arc length 682 and the gap are length 684 that form the deformed and undeformed segments, respectively, in the male closure elements. In one embodiment, the tooth arc length 682 and the gap arc length 684 are approximately equal but either may be longer than the other. Preferably, the tooth arc length 682 and the gap arc length 684 are about 0.15 of an inch {3.81 mm}. In another embodiment, the tooth arc length 82 is about 0.175 of an inch {4.44500 mm} and the gap arc length 84 is about 0.148 of an inch {3.75920 mm}. Depending upon the resiliency of the female profile, an excessively long deformed segment may allow the legs of the female profile to close back in onto the stem of the male profile. Hence, the resiliency of the female profile and length of the deformed segments are preferably chosen to prevent unsupported areas from resealing.

Figure 20:
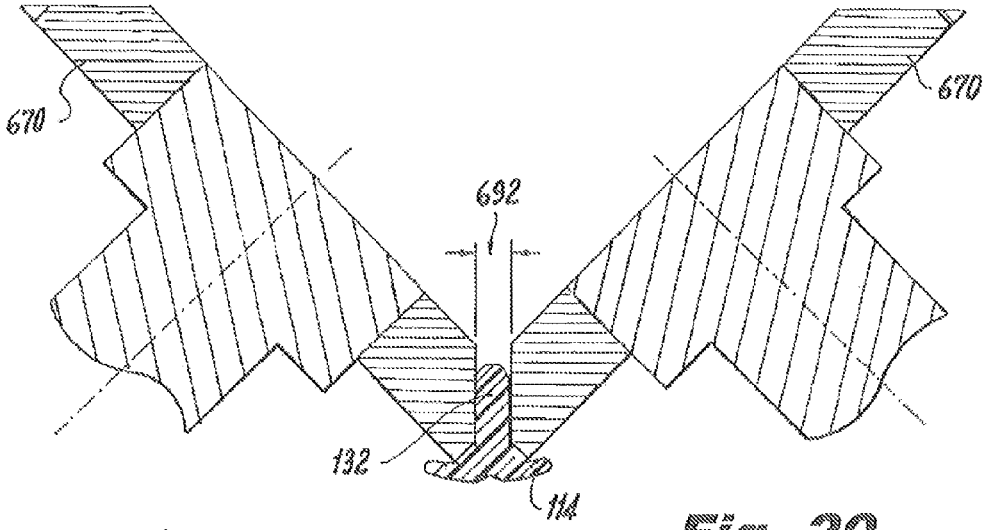
FIG. 20 is a partial view of a deforming apparatus utilizing two deformer rings as shown in FIGS. 17-19.

The deformer rings herein and technology related to the same may also be implemented in any deforming apparatus now known and later developed. One apparatus or process for making a male closure element for a reclosable thermoplastic bag in accordance with the subject technology would include an extruder for providing a longitudinally extending profile of a substantially uniform shape as shown in the normal segments above. As shown in FIG. 20, the deforming apparatus includes opposing deformer rings 670. The angled surfaces 688 of the deforming rings 670 are set parallel and apart a gap 692 approximately equal to a cross-sectional width of the neck portion of the stem plus or minus about 0.001 or 0.002 of an inch {0.0254 to 0.0508 mm}. Thus, as the male closure element 114 passes through the gap 692 at any linespeed, the distal head portion 134 and shoulder portion 130 are compressed and deformed. However, little or no compression or deformation of the neck portion 132 occurs to maintain the sealing surface area intact. Due to the cutting edges 694 impacting the male closure profile 114, fairly crisp step transitions between segments 124, 126 are formed. Depending upon various fabrication techniques, the transitions between segments 124, 126 may vary to certain degrees.

Figure 21:
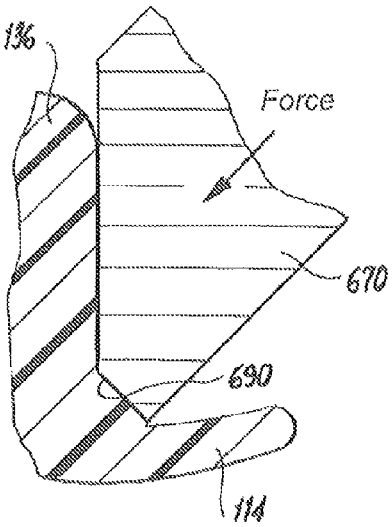
FIG. 21 an enlarged localized view of the deforming process of the deforming apparatus shown in FIG. 20.

Referring now to FIG. 21, an enlarged localized view of the deforming process is shown. Without being limited to any particular theory, in the region of the shoulder portion 130, excess material may form to create undesirable rebound or ripple effects for relatively long tooth arc lengths 682. To solve this problem, the relief notches 690 are provided are provided in the deforming wheel 670. The relief notches 690 provide an area into which the material being compressed may collect as shown by arrows 696. By allowing reshaped material to collect, compression proceeds by the teeth 674 up to that point and from that point forward with less or no rebound and ripple effects. The relief notches 690 may be of varying sizes and shapes.

Figure 22:
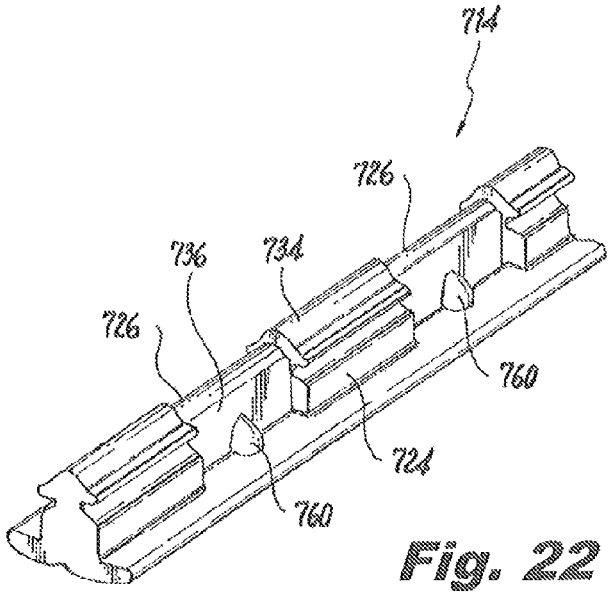
FIG. 22 is an enlarged perspective view of a male element of the closure mechanism produced by the deforming apparatus of FIG. 20.

Referring now to FIG. 22, an enlarged perspective view of a male closure profile 714 of a closure mechanism produced by a deforming apparatus having the deforming rings 670 of FIG. 20 is shown. As will be appreciated by those of ordinary skill in the pertinent art, the male closure profile 714 is similar to male closure profile 114 described above. Accordingly, like reference numerals preceded by the numeral "7" instead of the numeral "1" are used to indicate like elements and the following description is directed to the differences. The primary difference of the male closure profile 714 in comparison to the male closure profile 714 is the bump 760 centrally located in the deformed segments 726 adjacent the contoured base 728.

During opening and closing of a pouch with the male closure profile 714, the majority of the bump 760 is spaced from the sealing surfaces of the neck portion 732. Further, as the typical bump 760 is only 0.001 of an inch (0.0254 mm), the female legs 116*a*, 116*b* are resilient and flexible enough to contour to the bump 760 to maintain an effective seal in the event that the bump 760 extends into the neck portion 732.

Figure 23:
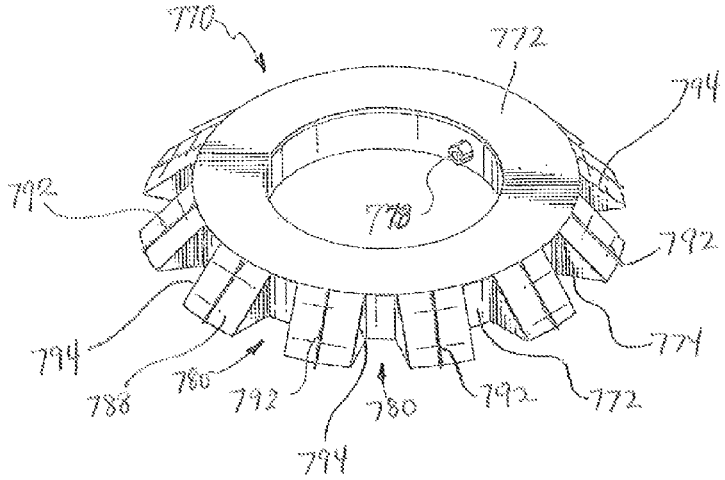
FIG. 23 is perspective view of another deformer ring for use in a deforming apparatus to manufacture a closure mechanism in accordance with the subject technology.
Figure 24:
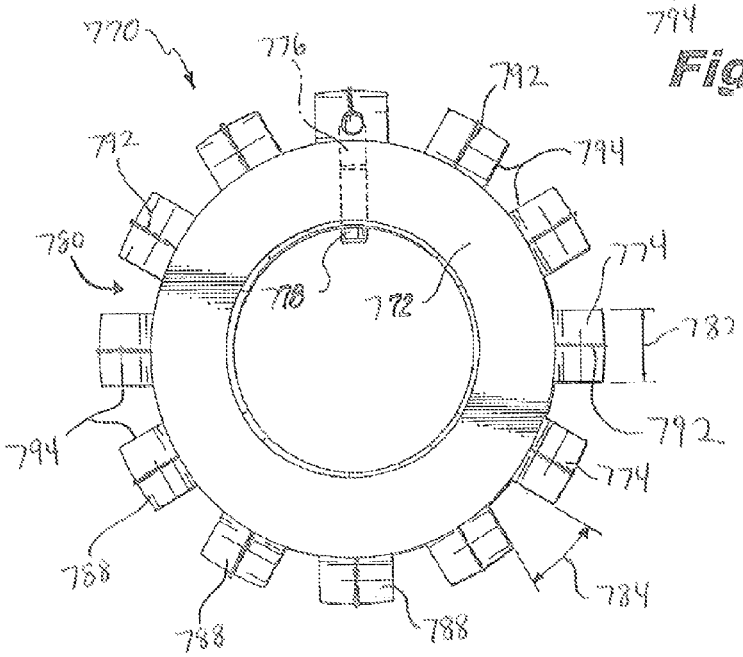
FIG. 24 is top view of the deformer ring of FIG. 23.

Now referring to FIGS. 23 and 24, perspective and top views of another deformer ring 770 for use in a deforming apparatus in accordance with the subject technology are shown. As will be appreciated by those of ordinary skill in the pertinent art, the deformer ring 770 is structurally similar to the deformer ring 670 described above. Accordingly, like reference numerals preceded by the numeral "7" instead of the numeral "6", are used to indicate like elements. The deformer rings 670, 770 and technology related to the same may also be implemented in any deforming apparatus now known and later developed.

The primary difference of deformer ring 770 in comparison to the defamer ring 670 is a linear ridge 792 instead of the relief notch 690. As a result of the linear ridge 792, the deformer ring 770 creates a central indentation in the deformed segments of the profile (not shown). Such an indentation may create a passageway for fluid inside the pouch to escape while the zipper is closed. Although the pouch may not seal perfectly, the passageway would provide the ability to squeeze out undesired interior fluid without undoing the seal. The linear ridge 792 may take any of a plurality of configurations. For example, the ridge 792 may have a triangular, square, polygonal, rounded or asymmetric cross-section. Further, depending upon the configuration of the linear ridge 792 and profiles, the indentations may seal effectively but create a passageway that opens upon pressure within the pouch being greater than ambient, e.g., during squeezing after closure. For example, the flexibility of the female profile is such that contact is maintained with the sealing surfaces in the indentation but tenuously so that pressure disrupts the seal, effectively a one-way valve.

Pouches fabricated by using the deformer ring 770 and the like would be useful for packaging items in which it is desirable to remove the air. For additional examples, it could include microwave packaging that requires venting during heating, packaging for items such as bread dough in which removal of accumulating gases such as carbon dioxide is desired, dry good like dried fruit and grains that do not require the protection of a large amount of air in the pouch, and the like.

Figure 25:
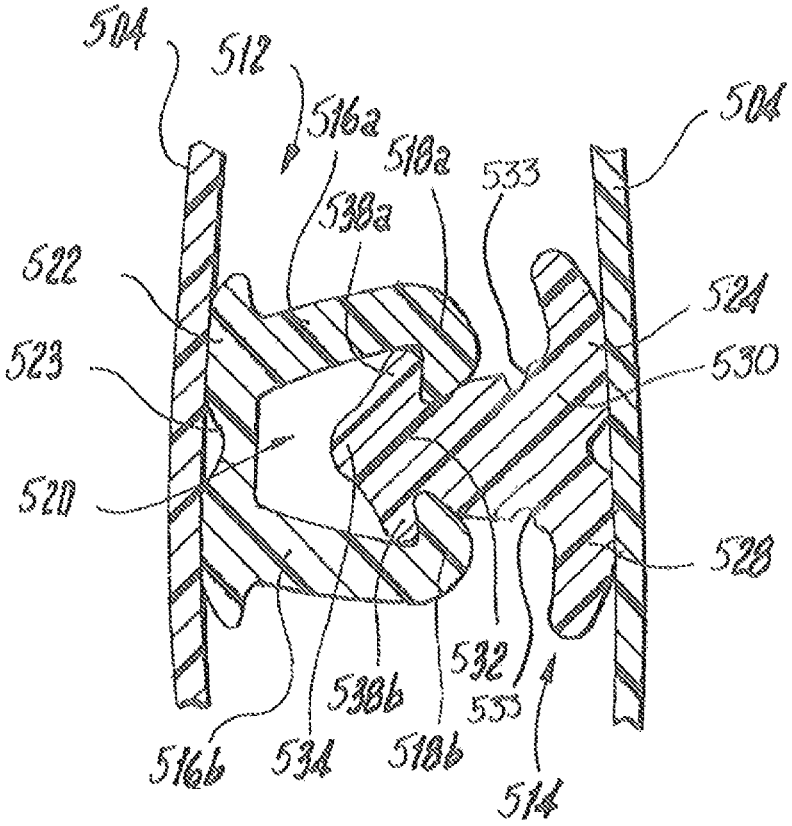
FIG. 25 is a sectional elevation showing the normal portion of another male closure element sealingly engaged to a female closure element.

Referring now to FIG. 25, a sectional elevation showing the normal portion of another male closure element 514 sealingly engaged to a female closure element 512 is shown. As will be appreciated by those of ordinary skill in the pertinent art, the male closure element 514 is structurally similar to the male closure elements 114 described above. Accordingly, like reference numerals preceded by the numeral "5" instead of the numeral "1", are used to indicate like elements.

The primary difference of the male closure element 514 in comparison to the male closure element 114 is a pair of opposing notches 533 in the shoulder portion 530 near the base 528. The notches 533 are formed during the extrusion process. Depending upon the deformation process, the notches may or may not be present in the deformed segments (not shown). As a result of the notches 533, the hook portions 518*a*, 518*b* can rest in the notches 533 during compression of the zipper. The notches 533 are sized and configured such that a user would discern the hook portions 518*a*, 518*b* entering the notches and, thereby, have affirmation that the zipper is in the venting position. Then during venting, the hook portions 518*a*, 518*b*, being somewhat captured in the notches 533, would at least partially if not completely prevent the zipper's natural tendency to return to the closed position.

In Operation with a Vacuum Machine

Closure mechanisms for pouches in accordance with the subject technology also provide benefits when used with a vacuum machine. The vacuum machine may be similar to that as shown in U.S. Patent Application Pub. No. 2005/0034427 or any other type appliance but without a heating element, which is not necessary. Instead of a heating element, the vacuum machine simply needs to be adapted and configured with a compression element to set the closure mechanism in the vented position. Once in the vented position, evacuation of air and liquids from the interior can be accomplished by the typical vacuum components of the prior art. An exemplary process is described below.

One process for utilizing a pouch 100 with closure mechanism 110 begins with loading the pouch 100 with the items to be stored. The closure mechanism 110 is closed as described above to seal in the items. Additional care may be taken to remove excess interior air but it is not necessary. The vacuum appliance is opened and may have markings to indicate how the closure mechanism 110 should be placed therein. The closure mechanism 110 may also have markings or simply have colored closure elements 112, 114 that not only provide a visual indication of proper closure but allow orientation to the vacuum appliance markings.

The vacuum appliance creates a sealed, evacuated pouch 100 by simultaneously compressing the closure mechanism 110 into the venting position while subjecting the opening 102 to vacuum. In one embodiment, a pair of opposing mating frames compress the closure mechanism 110 under a weight of a lid of the vacuum appliance. A hermetic seal surrounds the opening 102 in which a vacuum chamber is created. By having the closure mechanism 110 in the venting position and subjecting the opening 102 to vacuum, evacuation of the pouch occurs.

The vacuum appliance recognizes when the vacuum is accomplished and deactivates the vacuum mechanism. Upon lifting the appliance lid, the vacuum seal to the chamber and compression pressure on the closure mechanism 110 are released. The closure mechanism 110 naturally returns to the closed position because of the inherent springiness as described above. Hence, the pouch 100 has been effectively sealed with the interior evacuated while still being able to reopen and reuse the pouch 100 repeatedly. Further, as no heating element is required, the mechanical closure mechanism 110 is robust under wet conditions in which the prior art suffered from poor and ineffective sealing.

Incorporation by Reference

All patents, published patent applications and other references disclosed herein are hereby expressly incorporated in their entireties by reference.

While the invention has been described with respect to preferred embodiments, those skilled in the art will readily appreciate that various changes and/or modifications can be made to the invention without departing from the spirit or scope of the invention as defined by the appended claims. For example, each claim may depend from any or all claims in a multiple dependent manner even though such has not been originally claimed.

What is claimed is:

1. A recloseable pouch defining an interior, comprising:

a) a first wall;

b) a second wall opposing and partially sealed to the first wall to form an opening for access to the interior; and c) a closure mechanism for selectively sealing the opening, the closure mechanism including:

i) a female closure element coupled to the first wall, wherein the female closure element has first and second spaced legs extending from the first wall that define female sealing surfaces; and ii) a male closure element coupled to the second wall in alignment with the female closure element, wherein the male closure element includes a proximal base portion extending from the second wall, a neck portion forming male sealing surfaces to engage the female sealing surfaces, and a distal head portion, the male closure element having a plurality of intermittent normal and deformed portions, wherein the deformed portions have a thinner proximal base portion compared to the normal portions, wherein applying a compressive force to a portion of the closure mechanism when the female and male closure elements are engaged to seal the interior causes the first and second legs of the female closure element to splay outward and be spaced apart from the thinner proximal base portions and, in turn, a passageway in the intermittent deformed portions is formed between the splayed legs and the thinner proximal base portion for fluid to selectively flow past the closure mechanism.

2. A recloseable pouch as recited in claim 1, wherein the female sealing surfaces are formed on curved distal ends.

3. A recloseable pouch as recited in claim 1, wherein a resiliency of the spaced legs and a length of the deformed portions prevent resealing therein.

4. A recloseable pouch as recited in claim 3, wherein the plurality of intermittent portions have the distal head substantially squished upward while retaining at least a portion of the male sealing surfaces.

5. A recloseable pouch as recited in claim 3, wherein the proximal base portion has roughened surface portions so that upon inserting the proximal base portion into the female closure element, fluid is allowed to flow past the closure mechanism through the roughened surface portions.

6. A recloseable pouch as recited in claim 1, wherein the female and male closure elements are are substantially symmetric about a longitudinal centerline thereof.

7. A recloseable pouch defining an interior, comprising:

a) a first wall;

b) a second wall opposing and partially sealed to the first wall to form an opening for access to the interior; and c) a closure mechanism for selectively sealing the opening, the closure mechanism including: i) a female closure element coupled to the first wall having first and second spaced legs; and ii) a male closure element coupled to the second wall in alignment with the female closure element and configured to interlock and seal with the female closure element, wherein the male closure element includes a proximal base portion extending from the second wall, a neck portion forming male sealing surfaces to seal with the female closure element, and a distal head portion, the male closure element also having a plurality of intermittent normal and venting portions, the plurality of intermittent venting portions having the distal head substantially squished upward while retaining at least a portion of the male sealing surfaces, wherein once engaged, the closure mechanism is normally biased into a sealed position but upon applying a compressive force to a portion of the closure mechanism, the female closure element deforms and, in turn, a passageway in the intermittent venting portions is formed for fluid to flow past the closure mechanism.

8. A recloseable pouch as recited in claim 7, wherein the first and second spaced legs extend from a resiliently flexible base that stores energy when the first and second spaced legs are splayed outward by a force, wherein upon removal of the force, the base releases the energy to bias the closure mechanism into the sealed position.

9. A recloseable pouch as recited in claim 8, wherein the base defines a notch that allows the base to flex.

10. A recloseable pouch as recited in claim 7, wherein the normal portions of the male closure element include a tapered shoulder portion that splays the first and second spaced legs when inserted into the female closure element.

11. A recloseable pouch as recited in claim 10, wherein upon inserting the shoulder portion into the female closure element, the female closure element deforms and, in turn, fluid is allowed to flow past the closure mechanism via the adjacent venting portions.

12. A recloseable pouch defining an interior, comprising:

a) a first wall;

b) a second wall opposing and partially sealed to the first wall to form an opening for access to the interior; and c) a closure mechanism for selectively sealing the opening, the closure mechanism including: i) a female closure element coupled to the first wall, wherein the female closure element defines female sealing surfaces; and ii) a male closure element coupled to the second wall in alignment with the female closure element, wherein the male closure element defines male sealing surfaces to engage the female sealing surfaces with portions of the male closure element having first profile portions and second profile portions, the second profile portions being intermittent and relatively smaller in cross-section than at least a portion of the first profile portions, wherein the at least a portion of the first profile portions is a shoulder portion of the profile portions, the shoulder portion extending from a base coupled to the second wall and terminating with a neck portion and a distal head portion, and the shoulder portion is about 0.010 of an inch {0.25400 mm} wider than the neck portion in the first profile portions and about equal in the second profile portions, and wherein in a closed position, the female and male sealing surfaces are engaged to seal the opening and, in a venting position, the female closure element deforms by insertion of the male closure element therein and, in turn, fluid is allowed to be released from the interior by flowing past the second profile portions.

13. A recloseable pouch as recited in claim 12, wherein the female closure element defines a channel having a diameter of about 0.032 of an inch {0.81280 mm} with an opening between the hook portions of about 0.010 of an inch {0.25400 mm}.

14. A recloseable pouch as recited in claim 13, wherein the gap between the hook portions is approximately 0.001 of an inch {0.0254 mm} less than the width of the neck portion.

15. A recloseable pouch as recited in claim 12, wherein the second profile portions are deformed by a pair of opposing toothed deformer wheels having a central relief notch in each tooth that forms a central indentation in the second profile portions.

16. A recloseable pouch defining an interior, comprising:

a) a first wall;

b) a second wall opposing and partially sealed to the first wall to form an opening for access to the interior; and c) a closure mechanism for selectively sealing the opening, the closure mechanism including: i) a female closure element coupled to the first wall, wherein the female closure element defines female sealing surfaces; and ii) a male closure element coupled to the second wall in alignment with the female closure element, wherein the male closure element defines male sealing surfaces to engage the female sealing surfaces with portions of the male closure element having first profile portions and second profile portions, the second profile portions being intermittent and relatively smaller in cross-section than at least a portion of the first profile portions, and the at least a portion of the first profile portions is a shoulder portion of the profile portions, the shoulder portion extending from a base coupled to the second wall and terminating with a neck portion and a distal head portion, wherein in a closed position, the female and male sealing surfaces are engaged to seal the opening and, in a venting position, the female closure element deforms by insertion of the male closure element therein and, in turn, fluid is allowed to be released from the interior by flowing past the second profile portions, and wherein a width of the neck portion is in a range from 0.008 to 0.018 of an inch {0.2032 to 0.4572 mm} at a sealing point and a width of the base is in the range from 0.015 to 0.028 of an inch {0.381 to 0.7112 mm}.

17. A recloseable pouch defining an interior, comprising:

a) a first wall;

b) a second wall opposing and partially sealed to the first wall to form an opening for access to the interior; and c) a closure mechanism for selectively sealing the opening, the closure mechanism including: i) a female closure element coupled to the first wall, wherein the female closure element defines female sealing surfaces; and ii) a male closure element coupled to the second wall in alignment with the female closure element, wherein the male closure element defines male sealing surfaces to engage the female sealing surfaces with portions of the male closure element having first profile portions and second profile portions, the second profile portions being intermittent and relatively smaller in cross-section than at least a portion of the first profile portions, and the at least a portion of the first profile portions is a shoulder portion of the profile portions, the shoulder portion extending from a base coupled to the second wall and terminating with a neck portion and a distal head portion, wherein in a closed position, the female and male sealing surfaces are engaged to seal the opening and, in a venting position, the female closure element deforms by insertion of the male closure element therein and, in turn, fluid is allowed to be released from the interior by flowing past the second profile portions, wherein the shoulder portion narrows gradually from the base to the neck portion.

18. A recloseable pouch defining an interior, comprising:

a) a first wall;

b) a second wall opposing and partially sealed to the first wall to form an opening for access to the interior; and c) a closure mechanism for selectively sealing the opening, the closure mechanism including: i) a female closure element coupled to the first wall, wherein the female closure element defines female sealing surfaces; and ii) a male closure element coupled to the second wall in alignment with the female closure element, wherein the male closure element defines male sealing surfaces to engage the female sealing surfaces with portions of the male closure element having first profile portions and second profile portions, the second profile portions being intermittent and relatively smaller in cross-section than at least a portion of the first profile portions, and the at least a portion of the first profile portions is a shoulder portion of the profile portions, the shoulder portion extending from a base coupled to the second wall and terminating with a neck portion and a distal head portion, wherein in a closed position, the female and male sealing surfaces are engaged to seal the opening and, in a venting position, the female closure element deforms by insertion of the male closure element therein and, in turn, fluid is allowed to be released from the interior by flowing past the second profile portions, wherein the female closure element has hook portions forming at least a portion of the sealing surfaces and the shoulder portion of the male closure element forms a pair of opposing notches near the base for engaging the hook portions, respectively, in the venting position.

19. A recloseable pouch defining an interior, comprising:

a) a first wall;

b) a second wall opposing and partially sealed to the first wall to form an opening for access to the interior; and c) a closure mechanism for selectively sealing the opening, the closure mechanism including:

i) a female closure element coupled to the first wall, wherein the female closure element has first and second spaced legs extending from the first wall that are substantially symmetric about a longitudinal centerline and define female sealing surfaces; and ii) a male closure element coupled to the second wall in alignment with the female closure element, wherein the male closure element includes a proximal base portion attached to the second wall, a shoulder portion extending from the proximal base to a neck portion forming male sealing surfaces to engage the female sealing surfaces, and a distal head portion, wherein the shoulder portion has a roughened surface so that upon inserting the shoulder portion into the female closure element, the female sealing surfaces slide onto the shoulder portion and, in turn, fluid is allowed to flow past the closure mechanism through the roughened surface.

20. A recloseable pouch as recited in claim 19, wherein the distal head portion has a roughened surface.

21. A recloseable pouch as recited in claim 19, wherein the male closure element has a plurality of intermittent deformed portions so that upon inserting the proximal base portion into the female closure element, the female closure element deforms and, in turn, fluid is allowed to flow past the closure mechanism via the adjacent intermittent portions.

* * * * *